US012295431B2

(12) United States Patent
Béland

(10) Patent No.: US 12,295,431 B2
(45) Date of Patent: May 13, 2025

(54) SHOULDER PADS

(71) Applicant: SPORT MASKA INC., Montreal (CA)

(72) Inventor: Jean-François Béland, Montreal (CA)

(73) Assignee: SPORT MASKA INC., St-Laurent (CA)

( * ) Notice: Subject to any disclaimer, the term of this patent is extended or adjusted under 35 U.S.C. 154(b) by 25 days.

(21) Appl. No.: 17/928,418

(22) PCT Filed: Jun. 2, 2021

(86) PCT No.: PCT/CA2021/050749

§ 371 (c)(1),
(2) Date: Nov. 29, 2022

(87) PCT Pub. No.: WO2021/243453

PCT Pub. Date: Dec. 9, 2021

(65) Prior Publication Data

US 2023/0200464 A1 Jun. 29, 2023

Related U.S. Application Data

(60) Provisional application No. 63/034,090, filed on Jun. 3, 2020.

(51) Int. Cl.
*A41D 13/05* (2006.01)
*A63B 71/08* (2006.01)
(Continued)

(52) U.S. Cl.
CPC ..... *A41D 13/0512* (2013.01); *A41D 13/0518* (2013.01); *A41D 13/0562* (2013.01);
(Continued)

(58) Field of Classification Search
CPC ..... A41D 13/0512; A41D 13/0518; A41D 13/0562; A41D 13/0568; A41D 13/0556; A41D 13/0153; A41D 13/015; A63B 71/08; A63B 71/1291; A63B 2071/1208; A63B 2209/10; A63B 71/12; F41H 1/02
See application file for complete search history.

(56) References Cited

U.S. PATENT DOCUMENTS 6,138,277 A 10/2000 Gillen et al.
6,247,188 B1 * 6/2001 Beland ..... A63B 71/12 2/461

(Continued)

*Primary Examiner* — Aiying Zhao
(74) *Attorney, Agent, or Firm* — NORTON ROSE FULBRIGHT CANADA

(57) ABSTRACT

Protective shoulder pads, such as the type worn for playing ice hockey, including a central panel configured to cover a portion of a chest of the wearer and defining a centerline extending centrally therethrough, and two side panels partially overlapping the central panel and each disposed on opposite sides of a centerline of the central panel. Each of the side panels is rotatable relative to the central panel about a rotation axis located proximate an upper end of each of the side panels, so as to adjust a width of the protective shoulder pad which is defined between opposed outer lateral edges of the side panels. The side panels are securable to the central panel at a plurality of attachment points to maintain a selected width of the adjustable shoulder pad.

18 Claims, 5 Drawing Sheets

(51) Int. Cl.
*A63B 71/12* (2006.01)
*A63B 102/24* (2015.01)

(52) U.S. Cl.
CPC ..... *A41D 13/0568* (2013.01); *A63B 71/08* (2013.01); *A63B 71/1291* (2013.01); *A63B 2071/1208* (2013.01); *A63B 2102/24* (2015.10)

(56) References Cited

U.S. PATENT DOCUMENTS

| | | | | |
|---|---|---|---|---|
| 2007/0050884 | A1* | 3/2007 | Contant | A41D 13/0518 2/92 |
| 2009/0211001 | A1* | 8/2009 | Weimer | A63B 71/12 2/463 |
| 2011/0167548 | A1* | 7/2011 | Jourde | A41D 13/0518 2/463 |
| 2012/0180176 | A1* | 7/2012 | Neal | F41H 1/02 2/2.5 |
| 2013/0104302 | A1* | 5/2013 | Fream | A41D 13/0512 2/461 |
| 2017/0203191 | A1* | 7/2017 | Lemieux | A41D 13/0562 |
| 2017/0296903 | A1* | 10/2017 | Piombino | A63B 71/12 |
| 2019/0313712 | A1* | 10/2019 | Rusakov | A63B 71/12 |

* cited by examiner

SHOULDER PADS

CROSS-REFERENCE

The present application is a United States Patent Application filed under 35 U.S.C. 371 of International Patent Application No. PCT/CA2021/050749 filed Jun. 2, 2021, which claims priority on U.S. Patent Application No. 63/034,090 filed Jun. 3, 2020, the entire contents of both of which are incorporated herein by reference.

TECHNICAL FIELD

This disclosure relates generally to the field of sporting goods and, more particularly, to protective equipment of the type worn for ice hockey or other athletic and/or sporting activities.

BACKGROUND

Hockey (e.g. ice hockey) players use protective shoulder pads having a series of padded sections for protecting the chest, back, shoulders, and upper arm regions. These shoulder pads may be available in a variety of sizes to cater to different sizes of players. However, for some players, shoulder pads may be too tight in certain areas and too loose in others. There is therefore an ongoing need for protective shoulder pads that are better adapted to the physiology of players.

SUMMARY

There is accordingly provided protective shoulder pads, comprising: a neck portion defining a neck opening configured for receiving a head of a wearer; and a front panel assembly extending from the neck portion and configured for covering a chest of the wearer, the front panel assembly having a central panel and side panels disposed on opposite sides of a centerline of the central panel, upper ends of the side panels being fixed relative to the neck portion, lower ends of the side panels being laterally displaceable relative to the central panel and the neck portion to adjust a width of the front panel assembly defined between outer lateral edges of the side panels, and the lower ends of the side panels being removably securable to the central panel.

The protective shoulder pad(s) as described herein may also include one or more of the following additional elements and/or features, in whole or in part, and in any combination.

In certain embodiments, the outer lateral edges of the side panels are C-shaped and define concave portions oriented away from the centerline.

In certain embodiments, cushions are secured the outer lateral edges of the side panels.

In certain embodiments, the side panels are secured to the neck portion along a portion of a circumference of the neck opening.

In certain embodiments, the lower ends of the side panels are removably securable to the central panel at a plurality of attachment points, the plurality of attachment points are defined by hook-and-loop fasteners.

In certain embodiments, each of the side panels has a tab secured at a lower end thereof, the tabs extending from the side panels and wrapping around a lower edges of the central panel, the plurality of attachment points defined between the tabs and an outer side of the central panel, the outer side facing away from the wearer.

In certain embodiments, the two side panels are secured to one another at a location between the upper and lower ends thereof via an elastic strap.

In certain embodiments, the side panels define convex portions oriented away from a wearer and concave portions facing the wearer to receive a portion of a chest of the wearer.

In certain embodiments, the central panel includes three distinct padding elements disposed along the centerline, the central panel defining two hinge lines each between two corresponding ones of the three padding elements.

In certain embodiments, the central panel has a top section and a bottom section wider than the top section, the lower ends of the side panels removably securable to the bottom section.

In certain embodiments, the side panels are displaceable between a fully collapsed position wherein the side panels are closest to each other and to the centerline, and a fully extended position wherein the side panels are furthest away from each other and from the centerline, the side panels and the central panel overlapping one another in both the fully collapsed position and the fully extended position.

In certain embodiments, each of the side panels has a strap secured thereto proximate the lower end, the strap being interlocked with a strap secured to the central panel.

In certain embodiments, the upper ends of the side panels are rotatably fixed to the neck portion.

In certain embodiments, each of the side panels defines a cut-out extending from outer edges toward the inner edges thereof.

In certain embodiments, the lower ends of the side panels are removably securable to the central panel at a plurality of attachment points to adjust a width of the front panel assembly.

There is also provided, in accordance with another aspect, protective shoulder pads, comprising: a central panel configured to cover a portion of a chest of a wearer and defining a centerline extending centrally therethrough; and two side panels partially overlapping the central panel and each disposed on opposite sides of a centerline of the central panel, each of the side panels being rotatable relative to the central panel about a rotation axis located proximate an upper end of each of the side panels to adjust a width of the protective shoulder pad, the width defined between opposed outer lateral edges of the side panels, the side panels being securable to the central panel at a plurality of attachment points to maintain a selected width of the adjustable shoulder pad.

The protective shoulder pad(s) as described herein may also include one or more of the following additional elements and/or features, in whole or in part, and in any combination.

In certain embodiments, a neck portion defines a neck opening configured for receiving a head of a wearer, the two side panels being secured to the neck portion along a portion of a circumference of the neck opening.

In certain embodiments, the upper ends of the side panels are rotatably fixed to the neck portion.

In certain embodiments, the outer lateral edges of the two side panels are C-shaped and define concave portions oriented away from the centerline.

In certain embodiments, the side panels are displaceable between a fully collapsed position and a fully extended position, the side panels being closest to each other and to the centerline in the fully collapsed position and the side panels being furthest away from each other and from the centerline in the fully extended position, the side panels and the central panel overlapping one another in both the fully collapsed position and the fully extended position.

In alternate aspect, there is provided a shoulder pad, comprising: a neck portion defining a neck opening configured for receiving a head of a wearer; and a front panel assembly extending from the neck portion and configured for covering a chest of the wearer, the front panel assembly having a central panel and side panels disposed on opposite sides of a centerline of the central panel, upper ends of the side panels being fixed relative to the neck portion, lower ends of the side panels being laterally movable relative to the central panel and the neck portion to adjust a width of the front panel assembly, the lower ends of the side panels removably securable to the central panel, the width of the front panel assembly defined between outer lateral edges of the side panels.

In another alternate aspect, there is provided an adjustable front panel assembly for a shoulder pad, comprising a central panel and side panels disposed on opposite sides of a centerline of the central panel, upper ends of the side panels being fixed relative to the central panel, lower ends of the side panels being laterally movable relative to the central panel, the lower ends of the side panels removably securable to the central panel at a plurality of attachment points to adjust a width of the front panel assembly, the width of the front panel assembly defined between outer lateral edges of the side panels.

In yet another alternate aspect, there is provided a shoulder pad, comprising: a central panel configured to cover a portion of a chest of a wearer and two side panels being partially covered by the central panel; the two side panels being rotatable about rotation axes located proximate upper ends of the two side panels to adjust a width of the adjustable shoulder pad, the width defined between opposed outer lateral edges of the side panels, the side panels being securable to the central panel at a plurality of attachment points to maintain a desired width of the adjustable shoulder pad.

Many further features and combinations thereof concerning the present improvements will appear to those skilled in the art following a reading of the instant disclosure.

DETAILED DESCRIPTION

Figure 1:
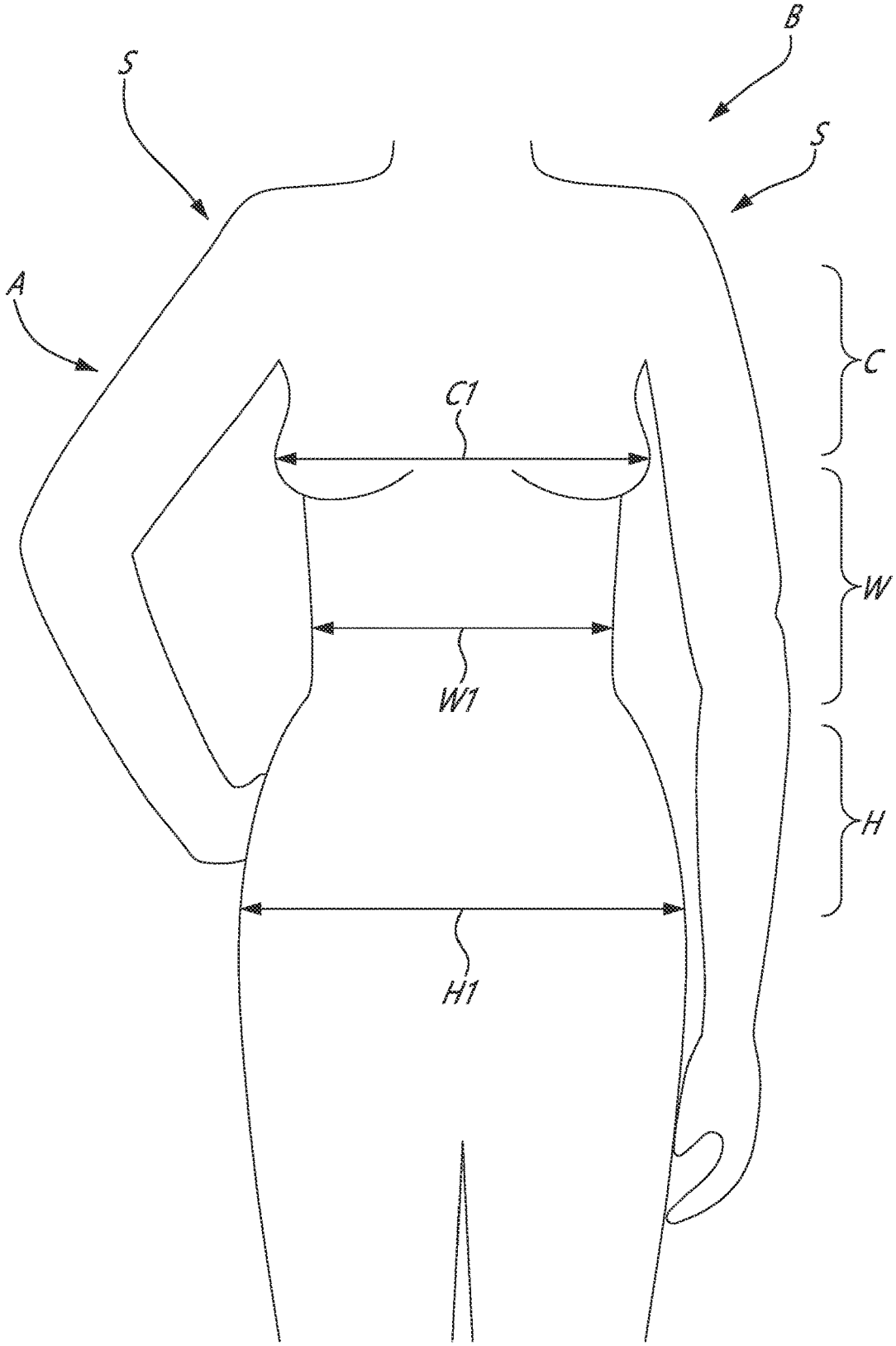
FIG. 1 is a schematic view of the anatomy of a female body.

FIG. 1 schematically illustrates the anatomy of the torso of the female body B including chest C, waist W, and hips H. Typically, the dimension, such as a circumference or width, H1 of the hips H is greater than a circumference or width W1 of the waist W. The circumference or width C1 of the chest C may also vary greatly from one woman to another depending on body type, ribcage (band) size and/or cup size. The standard deviation of the ratio of the width C1 of the chest C to the width W1 of the waist W may be less for men than it is for women, mainly because of the higher variability in chest sizes in women.

Although the term "width" is used herein to refer to the dimensions C1, W1 and H1 of the chest, waist and hips, respectively, it is to be understood that a circumference of the body at these locations could also be used as a reference measurement in place of a planar width.

Most existing protective sports equipment in general, and most ice hockey protective equipment in particular, has not been designed with female wearers/players in mind. For female athletes, and in particular for female hockey players, the above-noted physiological differences can result in a sub-optimal equipment fit. For example, a woman having a larger than average chest size may need to buy a shoulder pad of a size Large ("L") to accommodate her chest C size. However, such a size-Large shoulder pad may be too wide for her shoulder S and/or too loose at her waist W.

A protective shoulder pad assembly, which may also be referred to herein as "protective shoulder pads", "shoulder pads" or simply a "pad", is shown generally at 10. These protective shoulder pads may be of the type worn to protect the wearer during sporting activities, including but not limited to ice hockey.

As will be described below, the pad 10 is adjustable to cater to a variety of chest sizes and may at least partially alleviate the aforementioned problems. The shoulder pads 10 as described herein are particularly designed for women, given the aforementioned challenges which exist for female hockey players to find adequately fitting equipment that is specifically intended for their anatomy. However, it is to be understood that the shoulder pads as described herein could similarly be worn by men, and may simply be used should a better fit be required such as to suit the particular anatomy of the wearer, regardless of their gender. The pad 10 of the present disclosure accordingly provide additional adjustment and/or fit options for a variety of hockey players, including but not limited to those who have a physiology that is outside the standard "norm" for which such protective equipment is typically designed.

Figure 2:
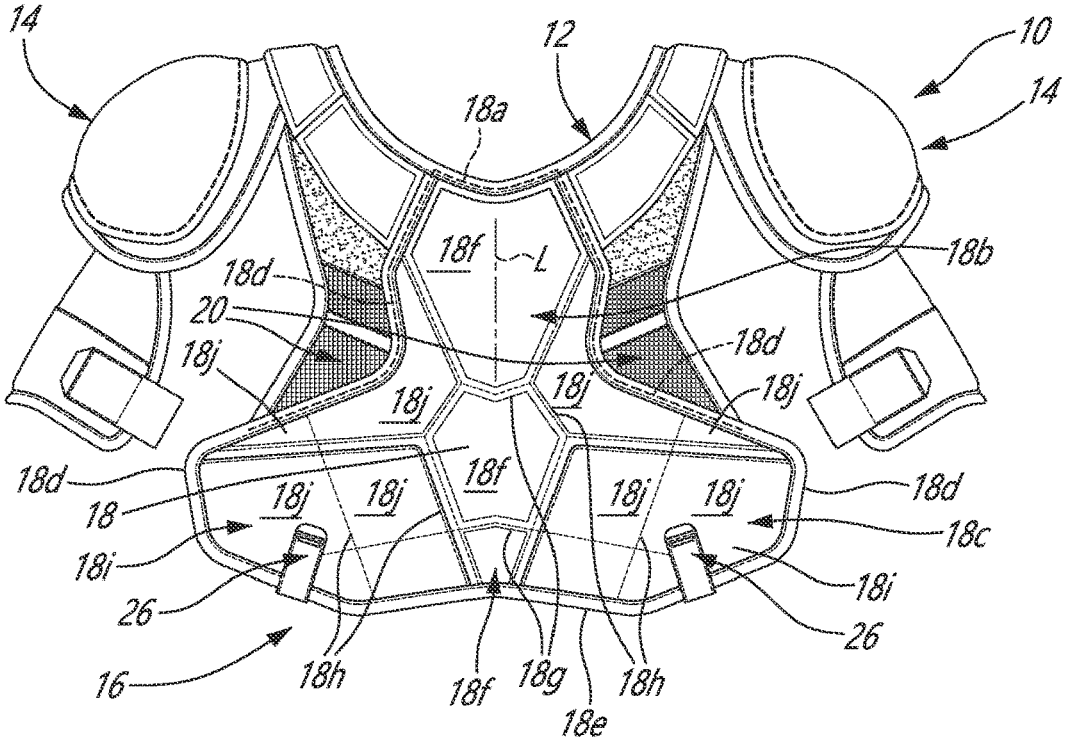
FIG. 2 is a front view of a shoulder pad in accordance with one embodiment.
Figure 3:
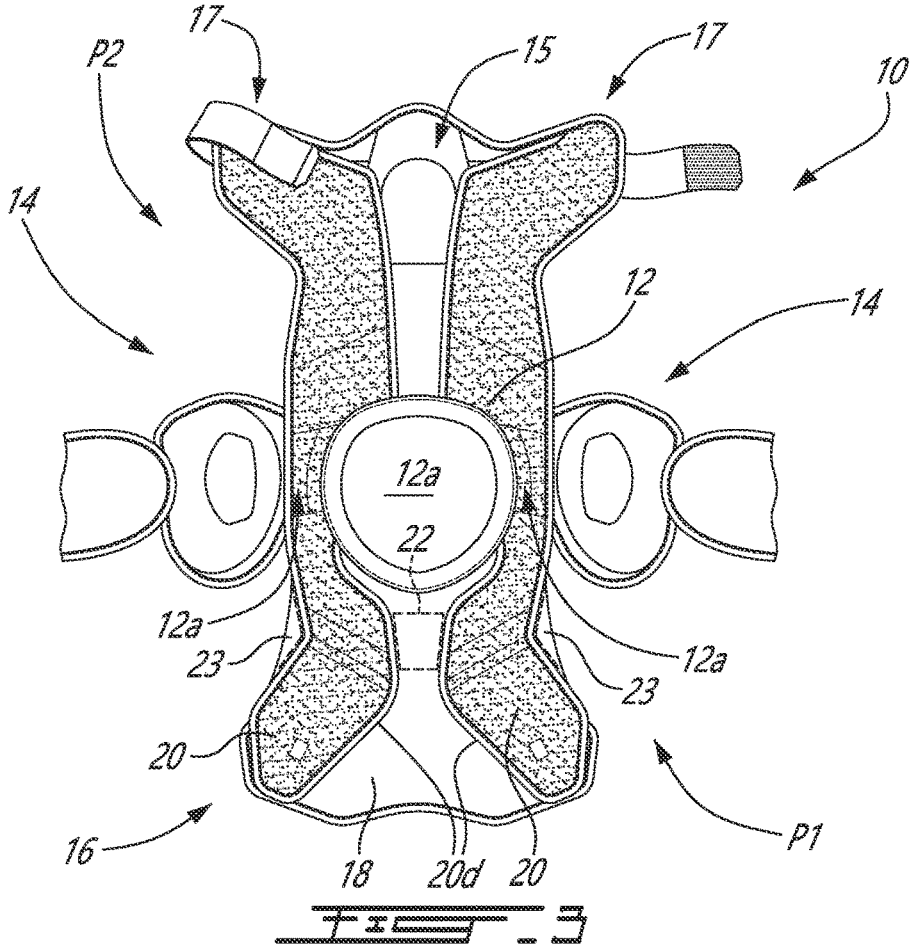
FIG. 3 is a bottom plan, inner view of the shoulder pad of FIG. 2, shown in an opened-out flat position.

Referring now to FIGS. 2-3, a front view of the pad 10 is shown in FIG. 2 whereas FIG. 3 illustrates an open inner view of the pad 10 with both front P1 and back P2 portions of the pad 10.

The pad 10 includes a neck portion 12 defining a neck opening 12*a*; shoulder portions 14 that may extend from the neck portion 12 and configured for covering shoulders S (FIG. 1) and parts of arms A (FIG. 1) of the wearer B; and a front panel assembly 16, which may extend from the neck portion 12. The front panel assembly 16 is part of the front portion P1 of the pad 10 and may be configured to cover the chest C of the wearer.

The neck portion 12 may include padding elements 12*b* (FIG. 2) distributed in a way to enhance protection of key parts of the body B. The neck portion 12 may include a plurality of padding elements 12*b* that may be distributed around the neck opening 12*a*. The padding elements 12*b* may be contained within pockets defined by a fabric casing and separated from one another by stitch lines. Other configurations are contemplated. The back portion P2 of the pad 10 may include panels, namely a central rear panel 15 and two side rear panels 17 attached to the central rear panel 15; the central and side rear panels 15, 17 extend from the neck portion 12. Each of the central and side rear panels 15, 17 may include one or more padding element for protection of a back of the wearer.

In the present embodiment, the front panel assembly 16 includes a central panel 18 and two side panels 20 that may be movable toward and away from one another to provide a width adjustability of the pad 10 in its chest area as will be described below. An overlap may be present between the side panels 20 and the central panel 18. The side panels 20 may be located between the chest C (FIG. 1) of the wearer B and the central panel 18.

In the embodiment shown, the central panel 18 has a top edge 18*a* that extends from the neck portion 12. In a particular embodiment, the central panel 18 may define a portion of the neck portion 12. The top edge 18*a* of the central panel 18 may be curved to follow a shape of the neck opening 12*a*. The central panel 18 has a top section 18*b* and a bottom section 18*c*. The top section 18*b* defines the top edge 18*a*. The bottom section 18*c* may be wider than the top section 18*b*. The central panel 18 has a centerline L and two lateral edges 18*d* disposed on opposite sides of the centerline L. A portion of the lateral edges 18*d* is shown in dashed line in FIG. 2 to better illustrate the shape of the central panel 18 compared to that of the side panels 20. The central panel 18 has a bottom edge 18*e* connected to the two lateral edges 18*d*. The bottom edge 18*e* may be located proximate the waist W (FIG. 1) of the wearer B when worn.

As shown in FIG. 2, a distance in a direction transverse to the centerline L of the central panel 18 between the two lateral edges 18*d* is greater at the bottom section 18*c* than that at the top section 18*b*. The top section 18*b* of the central panel 18 may cover a portion of the chest C (FIG. 1) of the wearer B (FIG. 1); the portion including a sternum of the wearer. A remainder of the chest C of the wearer B may be covered by the side panels 12.

As for the neck portion 12, the central panel 18 may include a plurality of padding elements, namely lateral padding elements 18*j*, and central padding elements 18*f*. As shown in FIG. 2, three central padding elements 18*f* are used and disposed linearly along the centerline L and the lateral padding elements are disposed on both sides of the central padding elements 18*f*. Herein, eight lateral padding elements 18*j* are used; four on each sides of the central padding elements 18*f*. It is understood that other configurations are contemplated. In the embodiment shown, the central panel 18 includes a single base foam and the padding elements are added on an outer side of the single base foam. The single base foam is flexible to adjust to the wearer's contour whereas the padding elements are more rigid than the base foam and are less able to adjust to the wearer's contour. Adjustability of the base foam is kept at the intersections of the padding elements.

The padding elements 18*j*, 18*f* of the central panel 18 may be encased within pockets defined by a fabric and stitch lines. In the embodiment shown, the three central padding elements 18*f* are separated from one another by two stitch lines 18*g*; each of the two stitch lines 18*g* defines an hinge line about which the central padding elements 18*f* may pivot one relative to the other. These hinge lines may be substantially transverse to the centerline L. The ability of the three central padding elements 18*f* to pivot one relative to the other may allow the front panel 18 to more closely follow a shape of the chest C (FIG. 1) of the wearer B than an alternate embodiment having solely one padding element. For female wearers, these hinge lines 18*g* may allow the front panel to conform more accurately to a shape of their chest C. Lateral stitch lines 18*h* are used to separate the central padding elements 18*f* from the lateral padding elements 18*j* and may act as lateral hinge lines to allow the lateral padding elements 18*j* to pivot relative to the central padding elements 18*f* to follow a curvature of the body of the wearer at her waist W (FIG. 1). Those lateral hinge lines may be substantially parallel to the centerline L or slightly angled relative to the centerline L.

As previously discussed, a size of the chest C (FIG. 1) of a female wearer is highly dependent upon her band size and/or cup size. That is, a female wearer may have a shoulder size requiring a small (S) version of a shoulder pad but, because of her chest/cup size, said wearer may require to use a large (L) version of said shoulder pad. A size large may be adequately shaped for the chest C of said wearer, but may be too big for her shoulder S and/or hips H (FIG. 1). If said wearer buys the small version of the shoulder pad, portions of her chest C may remain uncovered and/or unprotected by the shoulder pad, or the pad may simply be uncomfortable to wear because it is too tight in the chest area.

As will be described herein below, the front panel assembly 16 of the disclosed shoulder pad 10 may be adjustable in width to accommodate female players having a variety of torso sizes (and in particular chest sizes).

As illustrated in FIG. 3, each of the side panels 20 may be secured to a respective one of the rear side panels 17 at their respective top edges and proximate the neck portion 12. The side panels 20 may be secured to the rear side panels 17 via stitch lines. The top edges of both of the side panels 20 and the rear side panels 17 may be located at a top most portion of the shoulder pad 10. The top most portion may correspond to a location where the shoulder pad lays against a top sections of the shoulders of the wearer.

Herein, the expression "secured" may include "stitched". It is however understood that any other suitable methods of securing or attached the portions together are contemplated without departing from the scope of the present disclosure, including for example fabric welding, bonding, etc.

Figure 4:
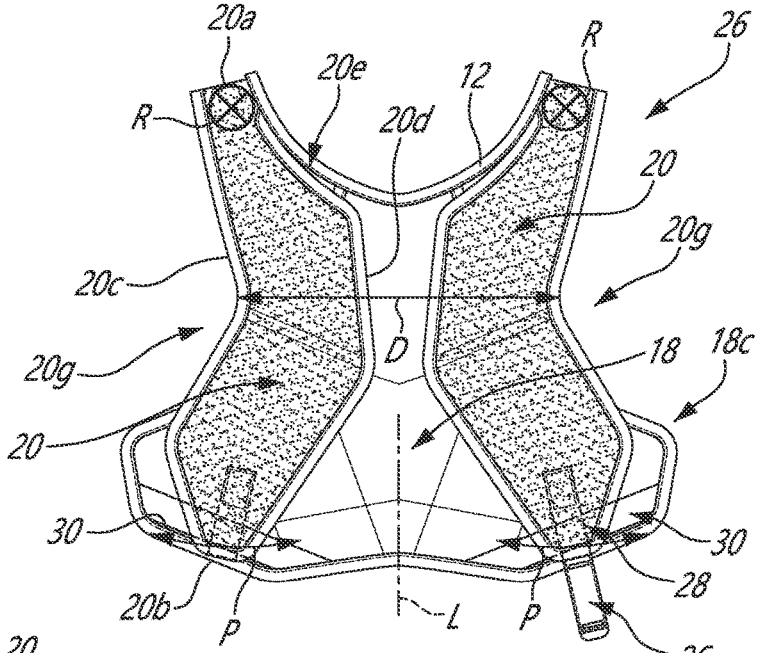
FIG. 4 is a rear view of a front panel assembly of the shoulder pad of FIG. 2, shown in an intermediary position.
Figure 5:
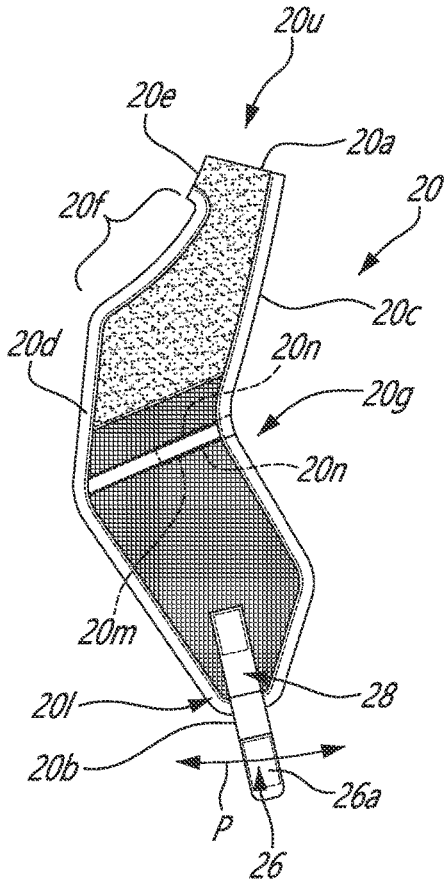
FIG. 5 is a front view of one of two side panels of the front panel assembly of FIG. 4.

Referring now to FIGS. 4-5, a rear view of the front panel assembly 16 and a front view of one of the side panels 20 are shown. In the embodiment shown, each of the side panels 20 has an upper end 20*u* and an opposed lower end 20*l*. Each of the side panels 20 has a top edge 20*a* at the upper end 20*u*, a bottom edge 20*b* at the lower end 20*l*, and outer and inner lateral edges 20*c*, 20*d* extending from the top edge 20*a* to the bottom edge 20*b*. The outer edges 20*c* face away from the centerline L and the inner edges 20*d* face one another. A first portion 20*e* of the inner edge 20*d* of each of the side panels 20 may be secured to the neck portion 12 of the pad 10. In other words, the top ends 20*u* of the side panels 20 are fixed relative to the neck portion 12 of the shoulder pad 10. As illustrated more clearly in FIG. 4, a second portion 20*f* of the inner lateral edge 20*d* is free of connection to a remainder of the front panel assembly 16. This may allow the second portion 20*f* of the inner lateral edges 20*d* of the side panels 20 to move relative to the neck portion 12 of the shoulder pad 10. In the embodiment shown, the outer edges 20*c* of the side panels 20 define concave portions 20*g* that may ease movements of the arms A (FIG. 1) of the wearer B (FIG. 1). In other words, the outer lateral edges 20*c* of the side panels have a C-shape. The concave portions 20*g* are oriented away from the centerline L.

Referring back to FIG. 3, the inner lateral edges 20*d* of the two side panels 20 may be secured to one another via a resilient member 22 shown in dashed lines. The resilient member 22 may be, for instance, an elastic fabric. The resilient member 22 may be used to limit movements of the two side panels 20 away from one another.

In the embodiment shown, cushions 23 are secured to the side panels 20 at their outer edges 20*c*; perimeters of the cushions 23 are shown in dashed lines in FIG. 3. The cushions 23 may extend partially away from the side panels 2—in a direction normal to said panels and toward a wearer. The cushions 23 may thereby create retention surfaces that may help in containing portions of the chest C (FIG. 1) of the wearer. This may be particularly useful when playing hockey, a sport involving rapid changes of direction and impacts.

Referring to FIG. 5, each of the side panels 20 may define one (or more) cutout 20*m* extending from the outer edges 20*c* toward the inner edges 20*d*. The cut-outs 20*m* may be delimited by two opposed edges 20*n* that may be stitched together. A pattern of the side panel 20 may define the cutout having a V-shape; the pattern being substantially flat. Upon stitching the two opposed edges 20*n* of the cut-outs 20*m*, the "V" is closed thereby causing the side panels 20 to form a cup shape for receiving a portion of the chest C (FIG. 1) of the wearer. In sewing, the cut-outs 20*m* may be referred as darts configured to provide a shape to the side panels 20. The cushions 23 may be centered relative to the cut-outs 20*m*.

Figure 6:
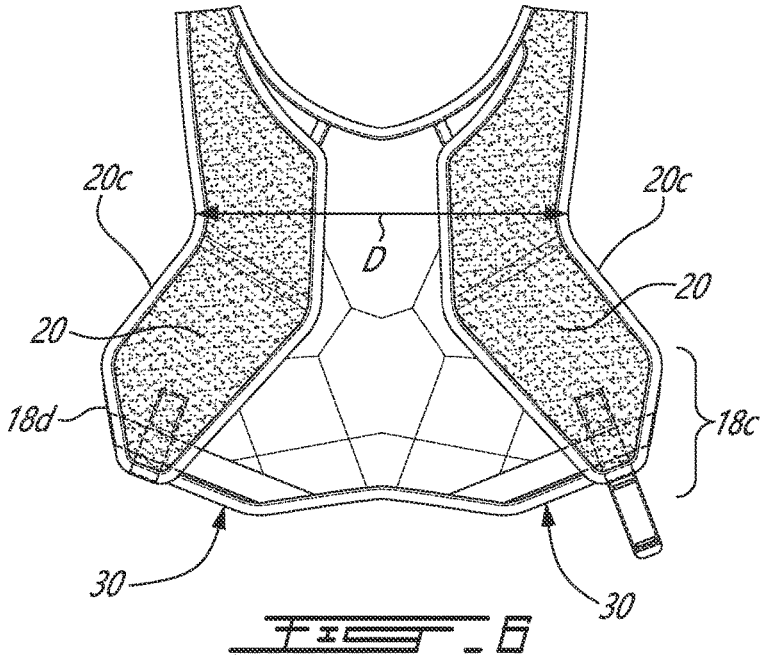
FIG. 6 is a rear view of the front panel assembly of the shoulder pad of FIG. 4, shown in an extended position.

Referring to FIGS. 4-8, the lower ends 20*l* of the side panels 20 are laterally movable relative to the central panel 18 and the neck portion 12; FIG. 4 illustrating an intermediary position whereas FIG. 6 illustrates a fully extended position. The lower ends 20*l* may move in a direction being substantially transverse to the centerline L. Rotation axes R (FIG. 4) may be defined at the upper ends 20*u* of the side panels 20; the side panels 20 being pivotable or rotatable bout the rotation axes R, such that the lower ends 20*l* thereof pivot about the rotation axes R along an arcuate travel path P (see FIGS. 4 and 5) to thereby change a lateral position of the lower ends 20*l* relative to the central panel 18.

Figure 7:
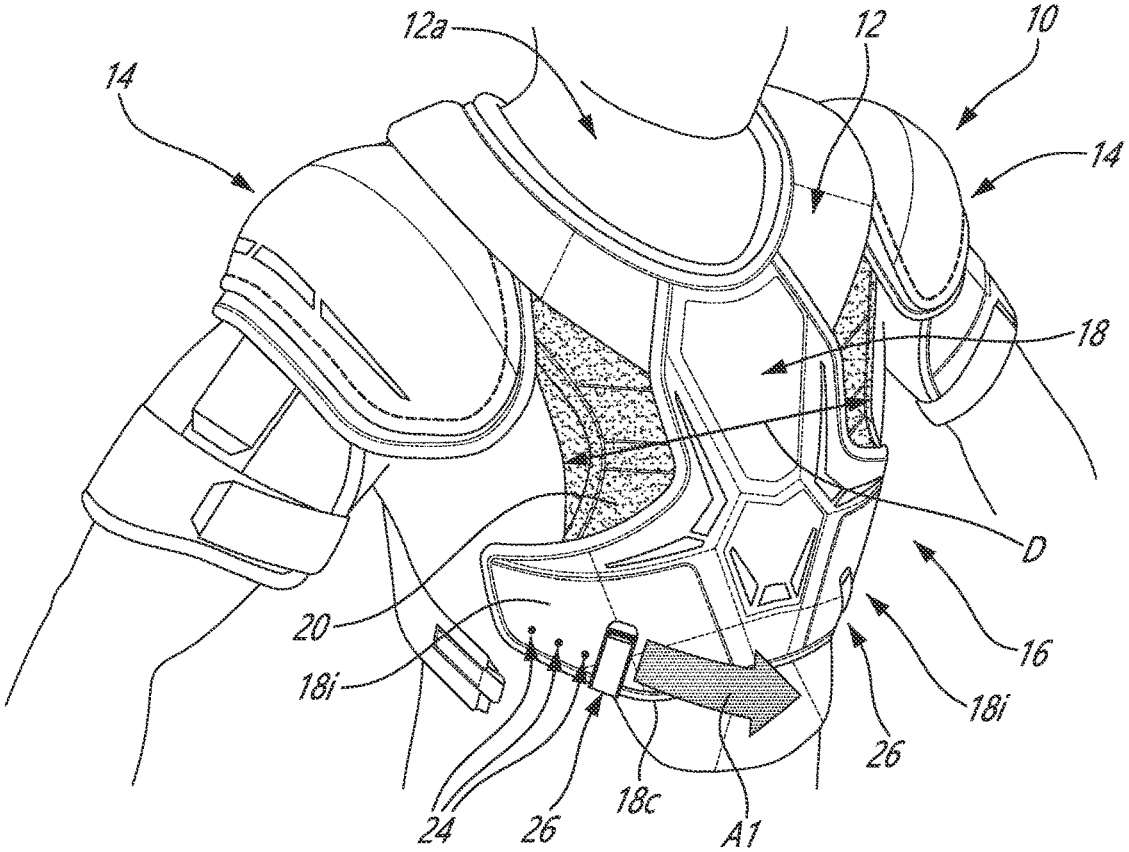
FIG. 7 is a schematic three-dimensional view of the shoulder pad of FIG. 2 on a wearer, and shown in a collapsed configuration.
Figure 8:
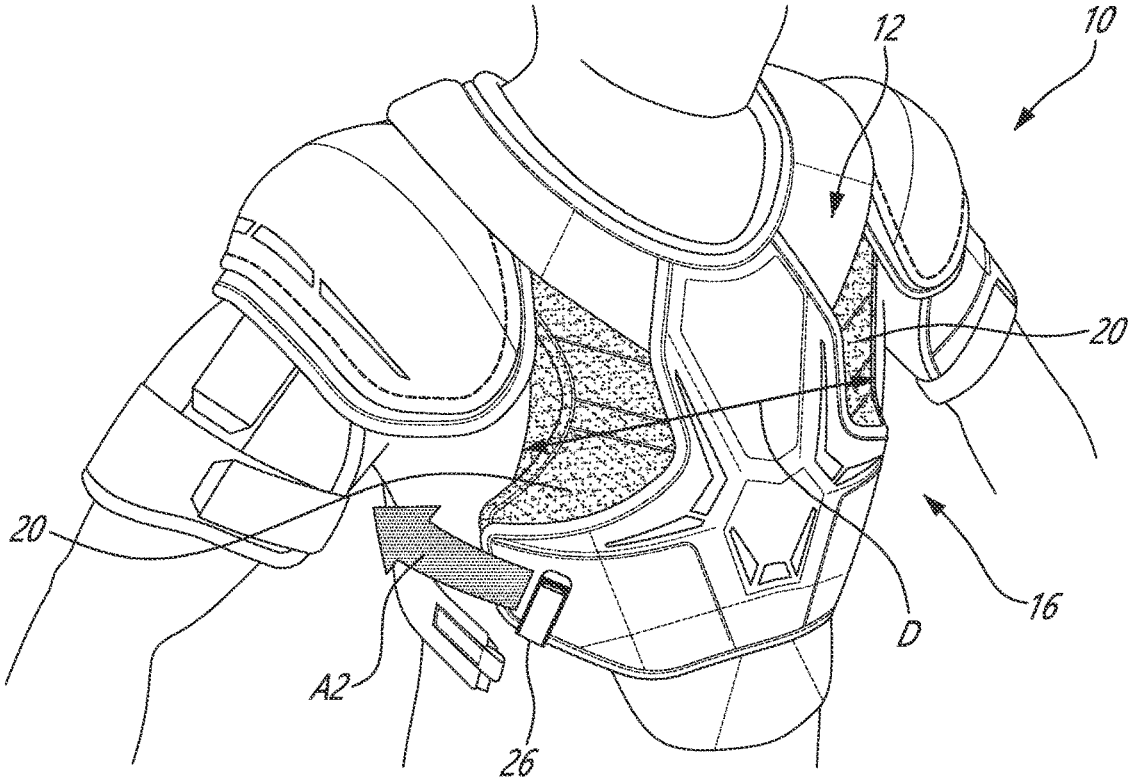
FIG. 8 is a schematic three-dimensional view of the shoulder pad of FIG. 2 on a wearer, and shown in an expanded configuration.

As shown in FIGS. 7-8, such a movement of the side panels may allow to increase a width D of the front panel assembly 16 by increasing the distance between the outer edges 20*c* of the two side panels 20. The width D of the front panel assembly 16 may be decreased by moving the side panels 20 toward one another as shown with arrow A1 in FIG. 7 and increased by moving the side panels 20 away from one another as shown with arrow A2 in FIG. 8.

The disclosed shoulder pad 10 may thus accommodate a plurality of chest/cup sizes of female players. For instance, a woman having a larger than average cup size that would normally require her to buy a large version of a shoulder pad that would be too wide for her shoulders, may now wear a small version of the shoulder pad 10 to properly fit her shoulders S (FIG. 1) and may choose to increase a distance between the outer edges 20*c* of the side panels 20, to increase the width D of the front panel assembly 16, to better cover her chest C (FIG. 1). An overall fit of a small version of the disclosed shoulder pad 10 having the side panels 20 spaced apart from one another at a maximum distance may be better than that of a larger version of a shoulder pad not shown herein.

Referring more particularly to FIG. 6, in the fully extended position, the outer lateral edges 20*c* of the side panels 20 are at least partially aligned with the two lateral edges 18*d* of the central panel 18. More specifically, in the fully extended position, the two side panels 20 may remain covered by the bottom section 18*c* of the central panel 18. Other configurations are contemplated.

Referring now to FIGS. 5 and 7, the lower ends 20*l* of the side panels 20 are removably securable to the central panel 18 at a plurality of attachment points 24 defined by the central panel 18 to adjust the width D of the front panel assembly 16. Although 3 attachment points 24 are shown in FIG. 7, more or less attachment points may be used. In the embodiment shown, the bottom section 18*c* of the central panel 18 defines attachment surface(s) 18*i* matingly engageable by tabs 26 secured to the side panels 20. The tabs 26 may extend from the lower edges 20*b* of the side panels and away from the side panels 20. Herein, the attachment surfaces 18*i* are located on an outer side of the central panel 18; the outer side facing away from the wearer. More specifically, the tabs 26 define attachment surfaces 26*a* configured to cooperate with the attachment surfaces 18*i* of the front panel 18. In the embodiment shown, the attachments surfaces 18*i*, 26*a* of the front panel and the tabs 18, 26 define hook-and-loop fasteners, such as Velcro™. Any other connection means, such as snap connectors, buttons, laces, and so on may be used without departing from the scope of the present disclosure.

In the embodiment shown, the tabs 26 are secured to the side panels 20 proximate the bottom edges 20*b* and have a length sufficient to allow the tabs 26 to wrap around the bottom edge 18*c* of the central panel 18 and to reach the attachment surface 18*i* located on the outer side of said central panel 18. In other words, a portion of the bottom section 18*c* of the central panel 18 is sandwiched between the tabs 26 and the side panels 20. Alternatively, the tabs 26 may be omitted and fastening surfaces may be located on the side panels 20, and the fastening surfaces 18*i* of the central panel 18 may be located on an inner side of the central panel 18 to face toward the side panels 20.

Figure 9:
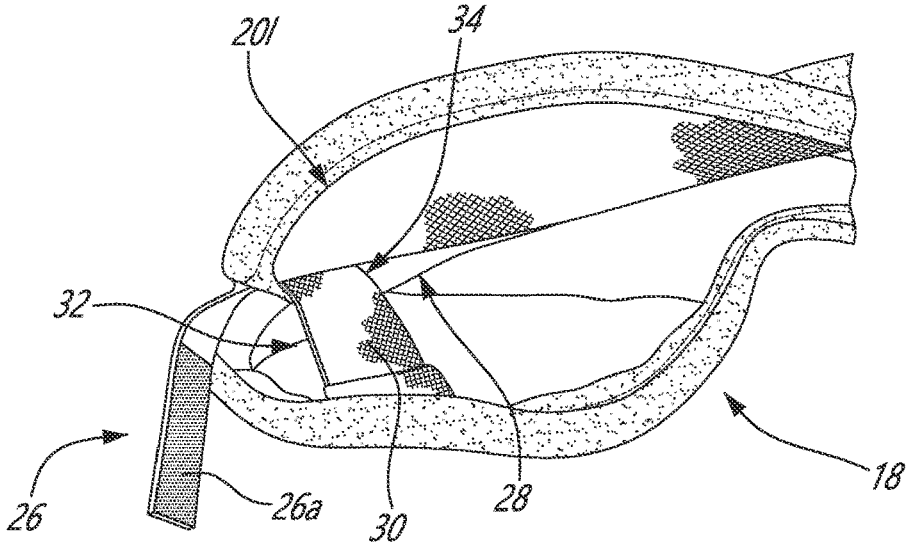
FIG. 9 is a side view of the front panel assembly of the shoulder pad of FIG. 2, illustrating an attachment between a central panel and one of the side panels.

Referring to FIGS. 5 and 9, to limit movements of the side panels 20 relative to the central panel 18, the side panels 20 and the central panel 18 have straps, or webbings, 28, 30 secured thereto. Each of the straps 28, 30 is secured to either one of the side panels 20 or the central panel 18 at two attachments points and is free of connection to the one of the side panels 20 or the central panel 18 between the two attachment points to define openings 32, 34. Each of the openings, or sleeves, 32, 34 defined by a corresponding one of the straps 28 of the side panels 20 and the straps 30 of the central panel 18 receives the other of the straps 28 of the side panels 20 and the straps 30 of the central panel 18. Stated differently, each of the straps 28, 30 is received within one of the sleeves 32, 34 defined by the other of the straps. In other words, for each of the side panels 20, the two straps 28, 30 are interlocked to limit an amplitude of movements of the side panels 20 relative to the central panel 18. The interlocking between the two straps 28, 30 allow a sliding motion one relative to the other. A size of the sleeves is greater than the widths of the straps to allow said sliding motion.

Figure 10:
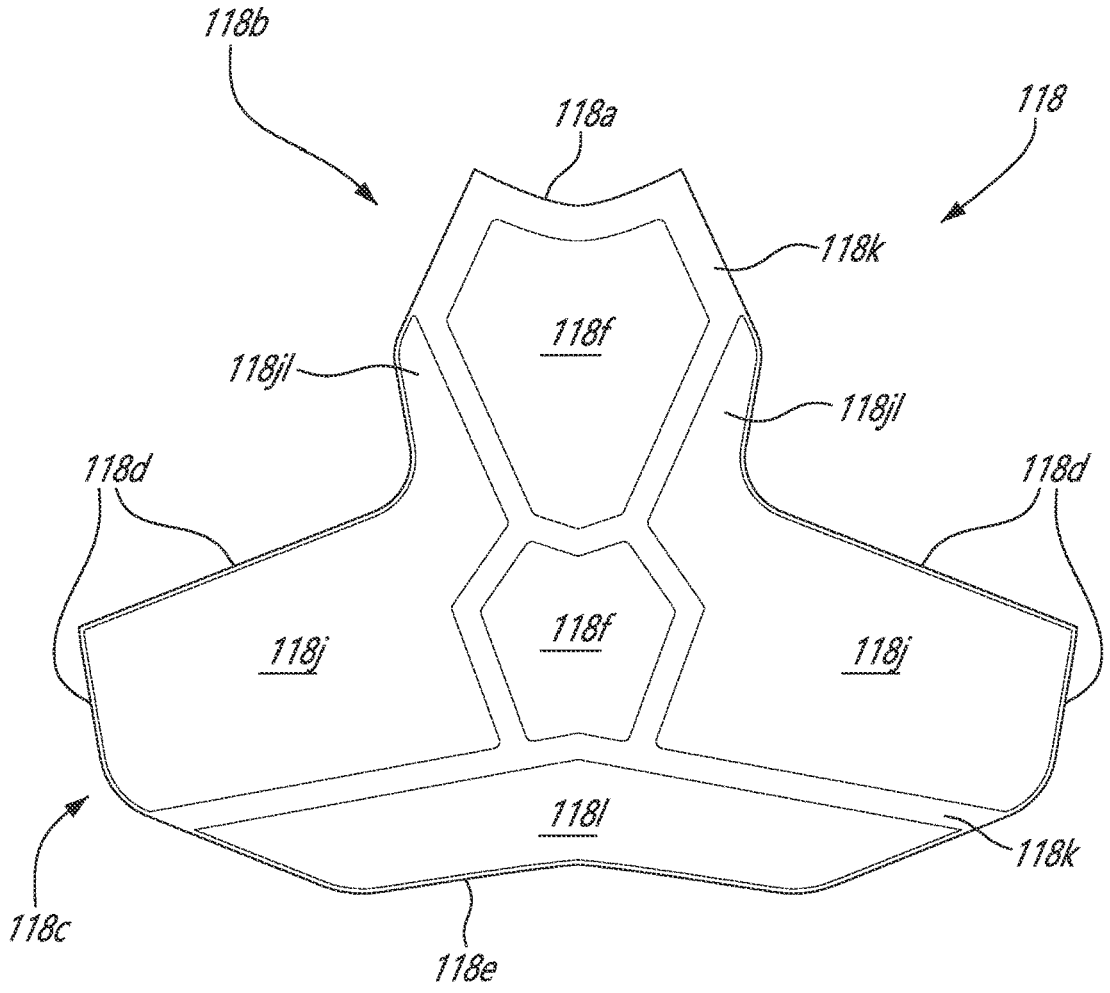
FIG. 10 is a schematic front view of a central panel of the shoulder pad of FIG. 2 in accordance with an alternate embodiment.

Referring to FIG. 10, a central panel in accordance with one embodiment of the shoulder pad is shown generally at 118. The central panel 118 has a top edge 118*a* and two lateral edges 118*d*. The central panel 18 has a bottom edge

118*e* connected to the two lateral edges 118*d*. A shape of the central panel 118 is similar to that of the central panel 18 described above with reference to FIG. 2.

The central panel 118 includes a plurality of padding elements. In the embodiment shown, the central panel 118 includes two lateral padding elements 118*j*, two central padding elements 118*f*, and one bottom padding element 118*l* for a total of five padding elements. In the embodiment shown, the central panel 118 includes a single base foam 118*k*, which is visible in FIG. 10 at gaps between two adjacent ones of the padding elements. The padding elements are added on an outer side of the single base foam 118*k*. The single base foam 118*k* is flexible to adjust to the wearer's contour whereas the padding elements are more rigid than the base foam and are less able to adjust to the wearer's contour. Adjustability of the base foam is kept at the intersections of the padding elements. In the present case, the two lateral padding elements 118*j* have top narrow portions 118*j*1 that protrude form a remainder of the lateral padding elements 118*j* and that form part of the top section 118*b* of the central panel 118. The bottom section 118*c* of the central panel 118 is formed conjointly by the remainder or the two lateral padding elements 118*j*, a bottom one of the two central padding elements 118*f*, and the bottom padding element 118*l*. The shoulder pad 10 described above may be use with either one of the two central panels 18, 118 described herein.

The disclosed shoulder pad 10 may allow to better fit female wearers who may exhibit a large range of cup sizes. The plurality of attachments points 24 may allow a granularity in the selection of the width D of the front panel assembly 16. Having the tabs 26 on the outer side may allow the wearer to easily adjust the width D of the shoulder pad 10 while wearing said shoulder pad 10. The interlocking straps 28, 30 may avoid the side panels 20 to completely detach and to move in a position where they may offer no protection. The pattern of the side panels 20 having one or more darts may allow the side panels 20 to define a shape for containing breasts of a female wearer. The cushions 23 defined by the side panels 20 may help in containing portions of the chest C of the wearer.

In the present specification including claims the expressions "top" and "bottom" relate to a position of elements relative to a ground on which a wearer or wearer stands. A top section of an element may be considered to be closer to the head of the wearer than a bottom section of said element.

It will be appreciated that many modifications may be carried to the disclosed shoulder pad without departing from the scope of the present disclosure. For instance, the two side panels may be secured to remainder of the front panel assembly via other means. The two side panels may be attached to the central panel at a location between upper and lower ends of the side panels.

Embodiments disclosed herein include:

A. A shoulder pad, comprising: a neck portion defining a neck opening configured for receiving a head of a wearer; and a front panel assembly extending from the neck portion and configured for covering a chest of the wearer, the front panel assembly having a central panel and side panels disposed on opposite sides of a centerline of the central panel, upper ends of the side panels being fixed relative to the neck portion, lower ends of the side panels being laterally movable relative to the central panel and the neck portion to adjust a width of the front panel assembly, the lower ends of the side panels removably securable to the central panel, the width of the front panel assembly defined between outer lateral edges of the side panels.

B. An adjustable front panel assembly for a shoulder pad, comprising a central panel and side panels disposed on opposite sides of a centerline of the central panel, upper ends of the side panels being fixed relative to the central panel, lower ends of the side panels being laterally movable relative to the central panel, the lower ends of the side panels removably securable to the central panel at a plurality of attachment points to adjust a width of the front panel assembly, the width of the front panel assembly defined between outer lateral edges of the side panels.

C. A shoulder pad, comprising: a central panel configured to cover a portion of a chest of a wearer and two side panels being partially covered by the central panel; the two side panels being rotatable about rotation axes located proximate upper ends of the two side panels to adjust a width of the adjustable shoulder pad, the width defined between opposed outer lateral edges of the side panels, the side panels being securable to the central panel at a plurality of attachment points to maintain a desired width of the adjustable shoulder pad.

Embodiments A, B, C may include any of the following elements, in any combinations:

Element 1: the outer lateral edges of the side panels are C-shaped and define concave portions oriented away from the centerline. Element 2: cushions secured the outer lateral edges of the side panels. Element 3: the side panels are secured to the neck panel along a portion of a circumference of the neck opening. Element 4: the lower ends of the side panels are removably securable to the central panel at a plurality of attachment points, the plurality of attachment points are defined by hook-and-loop fasteners. Element 5: each of the side panels has a tab secured at a lower end thereof, the tabs extending from the side panels and wrapping around a lower edges of the central panel, the plurality of attachment points defined between the tabs and an outer side of the central panel, the outer side facing away from the wearer. Element 6: the two side panels are secured to one another at a location between the upper and lower ends via an elastic strap or band. Element 7: the side panels define convex portions oriented away from a wearer and concave portions facing the wearer to receive a portion of a chest of the wearer. Element 8: the central panel includes three distinct padding elements disposed along the centerline, the central panel defining two hinge lines each between two corresponding ones of the three padding elements. Element 9: the central panel has a top section and a bottom section wider than the top section, the lower ends of the side panels removably securable to the bottom section. Element 10: the side panels are located between a chest of a wearer and the central panel. Element 11: the side panels and the central panel overlap one another in both of a fully collapsed position and a fully extended position. Element 12: each of the side panels has a strap secured thereto proximate the lower end, the strap being interlocked with a strap secured to the central panel. Element 13: the upper ends of the side panels are rotatably fixed to the neck portion. Element 14: each of the side panels defines a cutout extending from outer edges toward the inner edges thereof. Element 15: the lower ends of the side panels are removably securable to the central panel at a plurality of attachment points to adjust a width of the front panel assembly. Element 16: the outer lateral edges of the side panels are C-shaped and define concave portions oriented away from the centerline. Element 17: cushions secured the outer lateral edges of the side panels. Element 18: the side panels are secured to the neck panel along a portion of a circumference of the neck opening. Element 19: the plurality of attachment points are defined by hook-and-loop fasteners. Element 20: each of the side panels has a tab secured at a lower end thereof, the tabs extending from the side panels and wrapping around a lower edges of the central panel, the plurality of attachment points defined between the tabs and an outer side of the central panel, the outer side facing away from the wearer. Element 21: the two side panels are secured to one another at a location between the upper and lower ends via an elastic band or strap. Element 22: the side panels define convex portions oriented away from a wearer and concave portions facing the wearer to receive a portion of a chest of the wearer. Element 23: the central panel includes three distinct padding elements disposed along the centerline, the central panel defining two hinge lines each between two corresponding ones of the three padding elements to follow a shape of breasts of a wearer. Element 24: the central panel has a top section and a bottom section wider than the top section, the lower ends of the side panels removably securable to the bottom section. Element 25: the side panels are located between a chest of a wearer and the central panel. Element 26: the side panels and the central panel overlap one another in both of a fully collapsed position and a fully extended position. Element 27: each of the side panels has a strap secured thereto proximate the lower end, the strap being interlocked with a strap secured to the central panel.

As can be seen therefore, the examples described above and illustrated are intended to be exemplary only. The scope is indicated by the appended claims.

The invention claimed is:

1. Protective shoulder pads, comprising:

a neck portion defining a neck opening configured for receiving a head of a wearer; and a front panel assembly extending from the neck portion and configured for covering a chest of the wearer, the front panel assembly having a central panel and side panels disposed on opposite sides of a centerline of the central panel, upper ends of the side panels being fixed relative to the neck portion, lower ends of the side panels being laterally displaceable relative to the central panel and the neck portion to adjust a width of the front panel assembly defined between outer lateral edges of the side panels, and the lower ends of the side panels being removably securable to the central panel, the lower ends of the side panels being removably securable to the central panel at a plurality of attachment points defined by hook-and-loop fasteners, wherein tabs are secured to the side panels, the tabs wrapping around a lower edge of the central panel, the plurality of attachment points being defined between the tabs and the central panel.

2. The protective shoulder pads of claim 1, wherein the outer lateral edges of the side panels are C-shaped and define concave portions oriented away from the centerline.

3. The protective shoulder pads of claim 1, further comprising cushions secured the outer lateral edges of the side panels.

4. The protective shoulder pads of claim 1, wherein the side panels are secured to the neck portion along a portion of a circumference of the neck opening.

5. The protective shoulder pads of claim 1, wherein the side panels are secured to one another at a location between the upper and lower ends thereof via an elastic strap.

6. The protective shoulder pads of claim 1, wherein the side panels define convex portions configured to be oriented away from a wearer and concave portions configured for facing the wearer to receive a portion of a chest of the wearer when the protective shoulder pads are worn.

7. The protective shoulder pads of claim 1, wherein the central panel includes three distinct padding elements disposed along the centerline, the central panel defining two hinge lines each between two corresponding ones of the three padding elements.

8. The protective shoulder pads of claim 1, wherein the central panel has a top section and a bottom section wider than the top section, the lower ends of the side panels removably securable to the bottom section.

9. The protective shoulder pads of claim 1, wherein the side panels are displaceable between a fully collapsed position wherein the side panels are closest to each other and to the centerline, and a fully extended position wherein the side panels are furthest away from each other and from the centerline, the side panels and the central panel overlapping one another in both the fully collapsed position and the fully extended position.

10. The protective shoulder pads of claim 1, wherein each of the side panels has a strap secured thereto proximate the lower end, the strap being interlocked with a strap secured to the central panel.

11. The protective shoulder pads of claim 1, wherein the upper ends of the side panels are rotatably fixed to the neck portion.

12. The protective shoulder pads of claim 1, wherein each of the side panels defines a cut-out extending from outer edges toward inner edges thereof.

13. The protective shoulder pads of claim 1, wherein the lower ends of the side panels are removably securable to the central panel at a plurality of attachment points to adjust a width of the front panel assembly.

14. Protective shoulder pads for a female wearer, comprising:

a neck portion defining a neck opening configured for receiving a head of the female wearer;

a central panel secured to the neck portion and configured to cover a portion of a chest of the female wearer and defining a centerline extending centrally therethrough; and two side panels each secured to the neck portion via a securing portion of an inner lateral edge and partially overlapping the central panel and each disposed on opposite sides of a centerline of the central panel, the inner lateral edge having a free portion located lower than the securing portion and being free of connection to the neck portion, the free portion of the inner lateral edge extending towards the centerline of the central panel in a downward direction while curving to follow the neck opening, each of the side panels being rotatable relative to the central panel about a rotation axis located proximate an upper end of each of the side panels to adjust a width of the protective shoulder pad, the width defined between opposed outer lateral edges of the side panels, the side panels being securable to the central panel at a plurality of attachment points to maintain a selected width of the protective shoulder pad, each of the side panels having a dart to provide a cup shape to the side panels, the cup shape configured for receiving a portion of a chest of the female wearer when the protective shoulder pads are worn by the female wearer.

15. The protective shoulder pads of claim 14, wherein a portion of a circumference of the neck opening is free of connection to the side panels.

16. The protective shoulder pads of claim 15, wherein the upper ends of the side panels are rotatably fixed to the neck portion.

17. The protective shoulder pads of claim 14, wherein the outer lateral edges of the two side panels are C-shaped and define concave portions oriented away from the centerline.

18. The protective shoulder pads of claim 14, wherein the side panels are displaceable between a fully collapsed position and a fully extended position, the side panels being closest to each other and to the centerline in the fully collapsed position and the side panels being furthest away from each other and from the centerline in the fully extended position, the side panels and the central panel overlapping one another in both the fully collapsed position and the fully extended position.

* * * * *